United States Patent [19]

Barr et al.

[11] Patent Number: 4,676,324

[45] Date of Patent: Jun. 30, 1987

[54] DRILL BIT AND CUTTER THEREFOR

[75] Inventors: John D. Barr; John M. Fuller, both of Gloucestershire, United Kingdom

[73] Assignee: NL Industries, Inc., New York, N.Y.

[21] Appl. No.: 823,681

[22] Filed: Jan. 29, 1986

Related U.S. Application Data

[63] Continuation of Ser. No. 578,182, Feb. 8, 1984, which is a continuation-in-part of Ser. No. 443,657, Nov. 22, 1982, Pat. No. 4,505,302.

[51] Int. Cl.[4] ..... E21B 10/60

[52] U.S. Cl. ..... 175/393; 175/385; 175/329; 175/400

[58] Field of Search ..... 175/410, 329, 330, 339, 175/412, 327, 393, 400, 415, 417, 418, 385, 398

[56] References Cited

U.S. PATENT DOCUMENTS

| | | | |
|---|---|---|---|
| 2,371,490 | 3/1945 | Williams, Jr. | 175/400 |
| 3,955,635 | 5/1976 | Skidmore | 175/418 |
| 4,051,912 | 10/1977 | White | 175/415 |
| 4,098,363 | 7/1978 | Rohde et al. | 175/400 |
| 4,140,189 | 2/1979 | Garner | 175/410 |
| 4,200,159 | 4/1980 | Peschel et al. | 175/329 |
| 4,296,823 | 10/1981 | Gholson | 175/418 |
| 4,299,298 | 11/1981 | McEnery et al. | 175/400 |
| 4,341,273 | 7/1982 | Walker et al. | 175/393 |
| 4,351,401 | 9/1982 | Fielder | 175/410 |
| 4,440,247 | 4/1984 | Sartor | 175/393 |
| 4,478,297 | 10/1984 | Radtke | 175/410 |
| 4,515,227 | 5/1985 | Cerkovnik | 175/393 |
| 4,553,615 | 11/1985 | Grainger | 175/309 |
| 4,574,895 | 3/1986 | Dolezal et al. | 175/400 |

OTHER PUBLICATIONS

Christensen Catalog SD-666 dated Nov. 1981, p. 4.
Christensen Catalog SD-683 dated Feb., 1981.
Diamond Drilling Advertisement, 1980-1981 *Composite Catalog,* p. 2138.
Drilling & Service Advertisement Pioneers in Diamond Drilling, 1980-1981 *Composite Catalog,* p. 2317.

*Primary Examiner*—Stephen J. Novosad
*Assistant Examiner*—Bruce M. Kisliuk
*Attorney, Agent, or Firm*—Browning, Bushman, Zamecki & Anderson

[57] ABSTRACT

A full bore drag-type well drilling bit comprises a bit body having an operating end face defining a plurality of upsets. Each of the upsets has a leading edge surface and at least one recess extending through the leading edge surface into the upset. The end face of the bit body further comprises a plurality of flow channels, each such leading edge surface having one such flow channel extending therealong and inset therefrom. At least some of the upsets have a plurality of such recesses spaced therealong. The bit body further has a plurality of circulation ports opening through its end face and a plurality of nozzles, each nozzle being mounted in a respective one of the ports. The number of nozzles is less than the number of flow channels. At least some of the nozzles communicate with more than one such flow channel, and the transverse cross-sectional flow area of each of the nozzles is substantially less than those of individual ones of the channels communicating therewith. The bit further comprises a plurality of cutting members each mounted in a respective one of the recesses with a cutting face thereof facing outwardly along the leading edge surface of the respective upset.

19 Claims, 10 Drawing Figures

FIG. 2
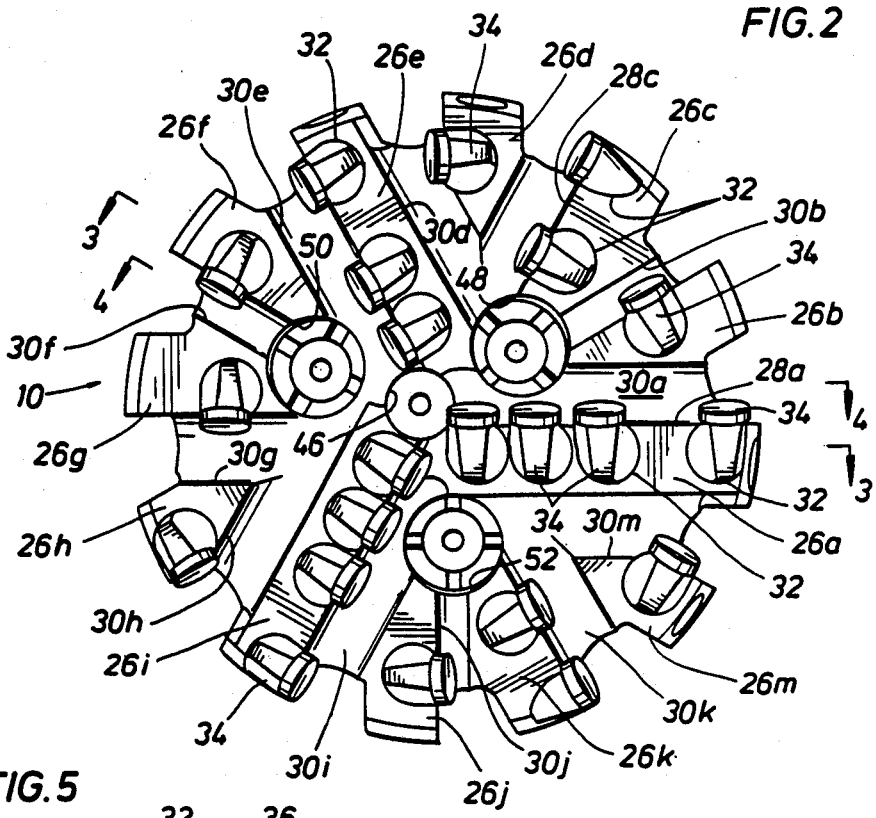
FIG. 5
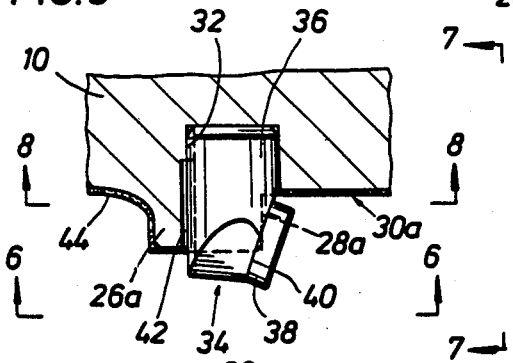
FIG. 7
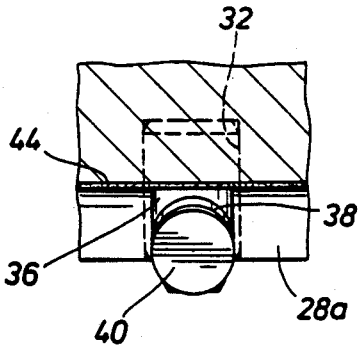
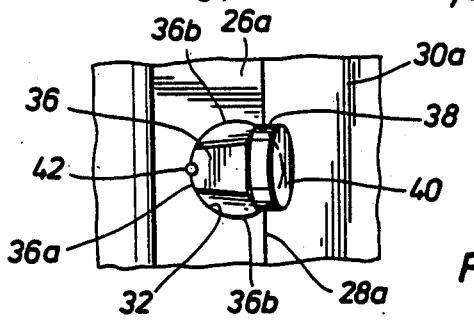
FIG. 6

12
54
16
16
10
18
18
22
22
58
56
62
60
36
36
40
34
46
34
26a

DRILL BIT AND CUTTER THEREFOR

CROSS-REFERENCE TO RELATED APPLICATION

This is a continuation of U.S. application Ser. No. 578,182, filed Feb. 8, 1984, which in turn is a continuation-in-part of U.S. application Ser. No. 443,657, filed Nov. 22, 1982, now U.S. Pat. No. 4,505,302.

BACKGROUND OF THE INVENTION

It has become common practice to dress drag type well drilling bits with cutting elements made of polycrystalline diamond compacts, or "PDC." Unlike a roller type drill bit, which primarily crushes the earth formation being drilled, a drag type bit more typically actually cuts or chips the earth formation. Thus, the use of diamond in the cutting elements is especially important in drag type bits in order to increase their life. The polycrystalline diamond material typically is supplied in the form of a relatively thin layer on one face of a substantially larger mounting body. The mounting body is usually post-like in configuration, and formed of a relatively hard material such as sintered tungsten carbide. The diamond layer may be mounted directly on the mounting body, or it may be mounted via an intermediate disc-like carrier, also comprised of sintered tungsten carbide. In any event, the diamond layer is disposed toward one end of the mounting body, the other end of which is mounted in a bore, pocket, or recess in the body of the drilling bit.

The bit body itself may be formed of a tungsten carbide matrix. Traditionally, drag bit bodies have also been made of various forms of steel. One problem which has been associated with the use of PDC type cutting members in such drag bit bodies has been damage to and/or loss of these cutting members. This may occur by cracking and shearing of the stud-like mounting body, which carries the diamond layer, near the outer surface of the bit body. Cutting members may also be lost when the mounting bodies become completely dislodged from the recesses in which they are mounted.

U.S. Pat. No. 4,244,432 discloses one form of prior drag bit. Although the bit has a pin and substructure of metal, it is essentially a tungsten carbide matrix type bit in that it comprises a thick layer of such matrix forming the operating end face and extending inwardly therefrom so that the recesses for mounting of the cutting members, as well as the circulation port system, are all formed of the tungsten carbide matrix. This outer matrix portion of the bit has a stepped configuration which, to a certain extent, provides improved support for the mounting bodies of the cutting members. However, the use of tungsten carbide matrix material for forming any substantial part of a bit body entails a number of disadvantages. In the first place, the tungsten carbide matrix material is per se relatively expensive. Furthermore, while highly wear resistant, this material lacks resiliency and is relatively susceptible to cracking and similar type damage. This last characteristic effectively limits the types of manufacturing procedures which may be utilized in forming matrix type bits. For example, any substantial amount of machining of such bits is highly impractical, and the essential configuration of the matrix body must be achieved by other techniques, essentially analogous to casting. Furthermore, it is extremely difficult to mount the cutting members in the recesses in the matrix bit body with an interference fit without damaging the bit body, the cutting members or both. Therefore, as a practical matter, the mounting bodies of the cutting members must be brazed into the recesses in the bit body. These more complicated manufacturing techniques, which are necessitated by the use of tungsten carbide matrix in the bit body, further increase the cost of the bit. Indeed, successful manufacturing of matrix type bits requires particular skill, expertise, and "art" not typically possessed by the average shop hand. Still another disadvantage of the matrix type bit body is its relatively poor thermal conductivity.

A number of the above disadvantages of matrix type bit bodies could, at least theoretically, be ameliorated by the use of a generally non-frangible metallic material, such as a suitable steel, for use in forming the bulk of the bit body. However, although there have been numerous efforts, beginning in the early to mid 1970's, to develop steel body drag bits with PDC cutting members, such efforts have not been entirely successful and, in particular, have not provided an adequate solution to the problem of damage and/or loss of the cutting members in use. Some of the earliest steel body PDC bits included a number of bores each with a concentric counterbore, the pairs of bores being located at various positions about the operating or cutting face of the bit body. The innermost bore of each pair provided the recess for mounting of the mounting body of the cutting member, whereas the larger but shallower outer bore provided access to the entirety of the diamond cutting face, theorectically for cooling and cleaning by the drilling mud. However, it was found that the mounting bodies of the cutting members on such bits did tend to crack or shear off as described hereinabove. Furthermore, the cooling and cleaning of the cutting faces by the drilling mud with such arrangements was less than satisfactory.

U.S. Pat. No. 4,323,130 and U.S. Pat. No. 4,265,324 illustrate efforts to improve upon the last-mentioned design by providing eccentric, rather than concentric, counterbores. Although these concentric arrangements provided some additional support for the mounting body of the cutting member in the area opposite the cutting face, still further improvements were desired. Additionally, the concentric counterbore scheme did not significantly improve the cooling and cleaning characteristics of the more basic concentric counterbore arrangement.

SUMMARY OF THE INVENTION

Certain aspects of the present invention are concerned primarily with solving the problems previously encountered in metallic body drag bits utilizing PDC type cutting members and, more particularly, with specific attention to full bore, as opposed for example to core head, type well drilling bits. The present invention not only alleviates the problems previously associated with these types of bits, but further positively utilizes the characteristics of the steel or other generally non-frangible metal of the bit body to provide even further advantages. Nevertheless, certain aspects of the present invention can also be advantageously employed in other types of bits, such as tungsten carbide matrix bits.

A bit according to the present invention comprises a bit body having an operating end face whose general configuration or profile includes a plurality of upsets each having a leading edge surface and at least one recess extending through such leading edge surface. The profile of the end face of the bit body further comprises a plurality of flow paths. Each of the leading edge surfaces of the upsets has one of these flow paths extending therealong and inset therefrom. As indicated hereinabove, it is preferably that the bit body be comprised of a generally non-frangible metallic material, such as steel, such material essentially defining the aforementioned profile, with the recesses extending into such metallic material. It is also preferable that at least some of the upsets have a plurality of such recesses spaced therealong.

The bit further comprises a plurality of cutting members carried by the bit body. Each of these cutting members includes an elongate mounting body and a cutting formation or cutting face on the exterior of the mounting body adjacent one end thereof. At least a majority of the mounting bodies on the bit are mounted in respective ones of the recesses in the upsets with their cutting formations facing outwardly along the leading edge surfaces of the upsets.

This upset arrangement, with the recesses extending into the leading edge surfaces of the upsets, makes it possible to provide much better support for the end of the mounting body carrying the cutting formation. For example, that end of the mounting body may be embedded in and supported by the aforementioned metallic material not only on the trailing side generally opposite the cutting formation but also in lateral areas adjacent the cutting formation. For example, in preferred embodiments, the walls of the recess abut the respective mounting body about significantly more than 180° of its periphery measured in a plane transverse to the cutting face or cutting formation. This structural relationship helps to alleviate the cracking and shearing problems described above, and these problems are further remedied by the use of a nonfrangible metallic material such as steel which, unlike a tungsten carbide matrix, is relatively resilient and can give to accommodate the forces imposed on the cutting member.

The upsets are preferably in the form of elongate ribs, each arranged to have a substantial radial component of direction, with respect to the end face of the bit body, at each point along its length. For those cutting members whose mounting bodies are mounted in recesses in these ribs, the cutting formations are fully exposed along the leading edge surfaces of the ribs, without the need for individual counterbores. The cutting formations may be generally planar cutting faces, and the bit body has a plurality of circulation ports opening through its end face. The number of such ports is preferably less than the number of flow paths extending along the leading edges of the ribs, and at least some of the ports communicate with more than one such flow path.

This arrangement, with relatively few ports, permits relatively high volume flow through each port, while the rib and flow path arrangement and its relationship to the ports organizes and directs the fluid flow to ensure improved cleaning and cooling of the cutting faces. The use of the elongate flow paths, as opposed to individual counterbores about each cutting member, also tends to reduce the problem of erosion of the bit body in the areas forward of the cutting members. Furthermore, for those cutting members whose mounting bodies are mounted in recesses in the ribs, each of the cutting faces lies generally coplanar to the next adjacent cutting face or faces on the same rib. Thus, the cutting faces themselves help to direct the fluid flow across one face and onto the next adjacent one. Additional cooling is provided by heat conduction through the metallic bit body, particularly enhanced by the substantial contact of this metallic material about a large portion of the periphery of the outer end of the mounting body of the cutting member, as described above.

The fact that there are relatively few circulation ports also permits each such port (or the nozzle therein) to have a relatively larger inner diameter, thereby reducing the possibility of clogging of the ports.

The use of a generally non-frangible metallic material also facilitates the manufacturing procedure by permitting the use of relatively easy machining processes to form the ribs and flow paths, recesses, and circulation ports. It is then also possible to mount the mounting bodies of the cutting members in their respective recesses with interference fits, e.g. by press fitting or shrink fitting.

It is a principal object of the present invention to provide improved fluid flow characteristics in and over a drag type drilling bit.

Still other objects, features and advantages of the present invention will be made apparent by the following detailed description, the drawings and the claims.

BRIEF DESCRIPTION OF THE DRAWINGS

FIG. 2 is a plan view of the operating end face of the drill bit taken along the line 2—2 in FIG. 1.

FIG. 5 is an enlarged detailed sectional view through one of the ribs and recesses, showing the respective cutting member in elevation.

FIG. 6 is a detailed plan view taken along the line 6—6 in FIG. 5.

FIG. 7 is a detailed view taken along the line 7—7 in FIG. 5.

DETAILED DESCRIPTION

Figure 1:
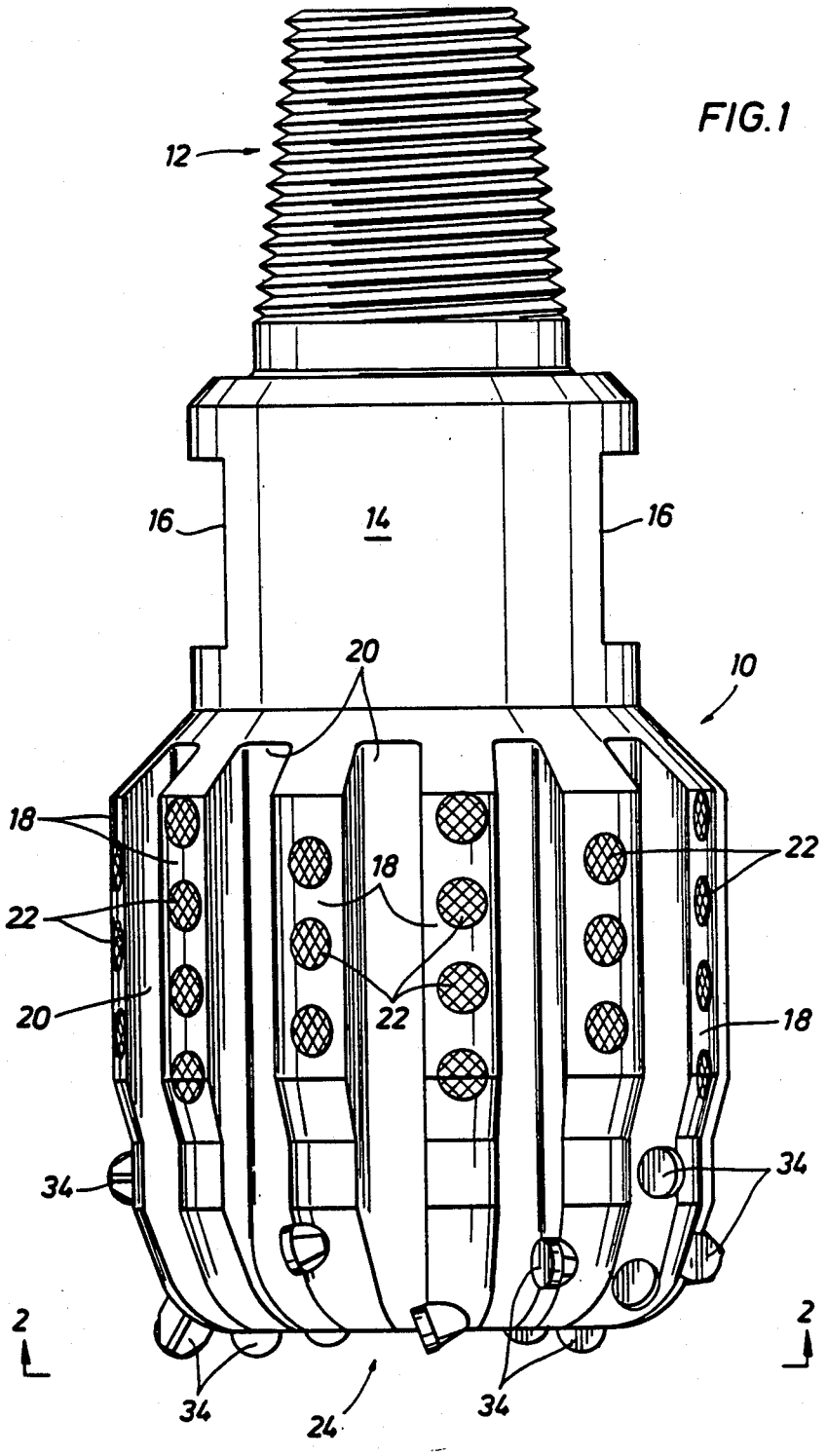
FIG. 1 is an elevational view of a drill bit according to the present invention.

Referring first to FIGS. 1 and 2, there is shown a full bore drag type drill bit according to the present invention. The bit includes a bit body 10 formed of steel or similar generally non-frangible metallic material, preferably having significant resiliency, as compared for example to tungsten carbide material, and also having relatively high heat conductivity. The bit body defined by such metallic material includes an uppermost pin 12 for connecting the bit to the lower end of a drill string. Below pin 12 is a neck 14 having bit breaker slots 16 which may be engaged by a suitable bit breaker plate for making up or breaking out the aforementioned connection to the drill string. Below neck 14, the bit body 10 widens to form a stabilizer section including alternating stabilizer blades 18 and junk slots 20. Stabilizer baldes 18 have buttons 22 of hard material such as tungsten carbide embedded therein to help reduce wear.

The lowermost end of bit body 10 defines the cutting or operating end face 24, best shown in FIG. 2. Face 24 of the bit body includes a number of upsets in the form of ribs *26a–26m*. The innermost ends of these ribs are located at various distances from the centerline of the bit body, each rib extending generally outwardly from its respective inner end in a direction which, while not truly radial, has a substantial radial component with respect to end face 24 of the bit body. Each of the ribs 26a–26m is continuous with a respective one of the stabilizer blades 18.

Each of ribs 26a–26m has a respective leading edge surface with respect to the intended direction of rotation of the bit. For example, the leading edge surface of rib 26a is shown at 28a, and the leading edge surface of rib 26c is shown at 28c. For convenience, these leading edge surfaces will be referred to herein as being "generally perpendicular" to the overall profile of end face 24, shown in FIG. 4, and thus to the profile of the earth formation being drilled. This term is used only in the most general sense, and should not be construed as excluding bits in which the ribs and their leading edge surfaces have some rake angle.

Alternating between ribs 26a–26m are a plurality of channel-like flow paths 30a–30m. Each of these flow paths extends along the leading edge surface of a respective one of the ribs 26a–26m, and is inset from that rib. Each of the flow paths 30a–30m is also continuous with a respective one of the junk slots 20 in the stabilizer portion of the bit body. Each of the ribs 26a–26m has at least one recess 32 opening through its leading edge surface and extending into the metal of the bit body. In the embodiment shown, each of the recesses 32 opens not only through the leading edge surface of its respective rib, but also opens generally axially outwardly through the outermost part of the rib, the opening of the recess traversing the corner formed between the leading edge surface and the longitudinally outermost surface of the rib. Although some of the shorter ribs have only a single recess therein, as shown in FIG. 2, at least some of the ribs, such as ribs 26a, 26c and 26e, have an array of recesses spaced therealong.

The bit further comprises a plurality of cutting members 34. An exemplary one of these cutting members, specifically one of those associated with rib 26a, is shown in detail in FIGS. 5–8. The cutting member 34 includes an elongate mounting body 36 formed of a hard material such as sintered tungsten carbide. Mounting body 36 has one end mounted in a respective one of the recesses 32. That portion of body 36 which is disposed in recess 32 will be referred to herein as the "stud portion" of the mounting body. The opposite end of member 36 extends outwardly through the mouth of the recess 32. Adjacent said outer end of the mounting body 36 and, more specifically, on that side which faces outwardly through the respective leading edge surface 28a of the rib 26a, there is mounted, as by bonding, a disc-shaped carrier 38, also formed of sintered tungsten carbide. On the outer surface of carrier 38 there is a layer 40 of polycrystalline diamond material, which serves as the cutting formation or cutting face of member 34. Cutting face 40 terminates in an outermost cutting edge 40a which engages the earth formation in use. Although cutting face 40 may have a suitable vertical or horizontal rake angle, it is arranged to face outwardly along, and lie generally parallel to, the respective leading edge surface 28a of the rib in which member 34 is mounted. Preferably, the mounting body 36 is interference press fitted into its recess 32. In order to key the cutting member to the proper orientation, with cutting face 40 facing outwardly through the leading edge 28a of rib 26a, the trailing side of the mounting body 36 and recess 32 are provided with small opposed grooves for receipt of a key pin shown at 42 in FIGS. 5 and 6. Alternatively, it is possible to provide only the groove in body 36, as the material of the bit body will be deformed into this groove during the interference fitting process to form an integral key.

By placing the opening of recess 32 in leading edge 28a and, more specifically, at the outermost corner of such leading edge, it is possible to allow full exposure of cutting face 40 through such leading edge without a counterbore about recess 32, while a significant portion of the adjacent outermost end of mounting body 36 is embedded in and supported by the metallic material of rib 26a. By comparison of FIGS. 5, 6 and 7, it can be seen that, at the outer end of mounting body 36, not only the trailing side 36a opposite cutting face 40, but also lateral portions 36b generally adjacent face 40 and its carrier 38 are thus embedded and supported. Indeed, it can be seen that the walls of recess 32 abut the outer end of the mounting body 36 about significant more than 180° of its periphery, when viewed in a plane transverse to cutting face 40 (see FIGS. 6 and 8). This relatively large amount of abutment and support near cutting face 40 helps to prevent cracking and/or breaking of mounting body 36 in use, and this effect is further enhanced by the inherent resiliency of the steel of which the bit body is formed, which can give to accommodate the forces imposed on the cutting member 34 in use.

In finished form, the bit body is coated with a thin layer 44 of tungsten carbide matrix or the like. However, this coating 44 is sufficiently thin that it does not significantly affect the aforementioned advantages of the use of steel to form the major part of the bit body. More specifically, it can be seen that the recess 32 extends into the steel, and that the steel defines the bulk of rib 26a and, in particular, the portion which supports the outer end of mounting body 36.

Eachof the other cutting members 34 is similarly mounted in a respective one of the recesses 32 in the various ribs 26a–26m. The cutting members of adjacent ribs are staggered in the generally radial direction, so that each cutting face 40 traverses the earth's formation at a slightly different distance from the centerline of the bit, and together, the cutting faces 40 cover substantially the entire end of the borehole in use.

Figure 3:
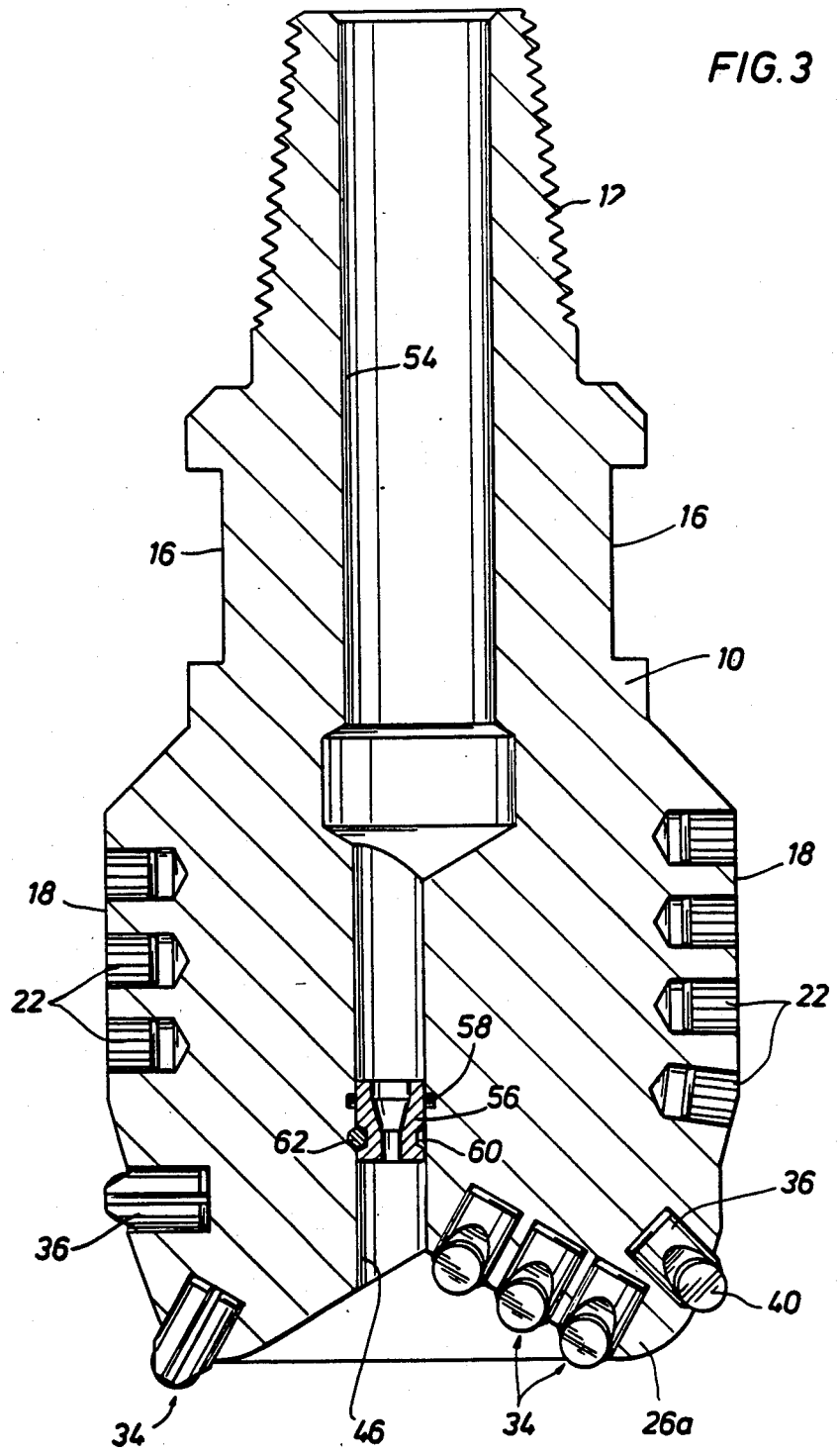
FIG. 3 is a vertical cross-sectional view taken along the line 3—3 of FIG. 2.
Figure 4:
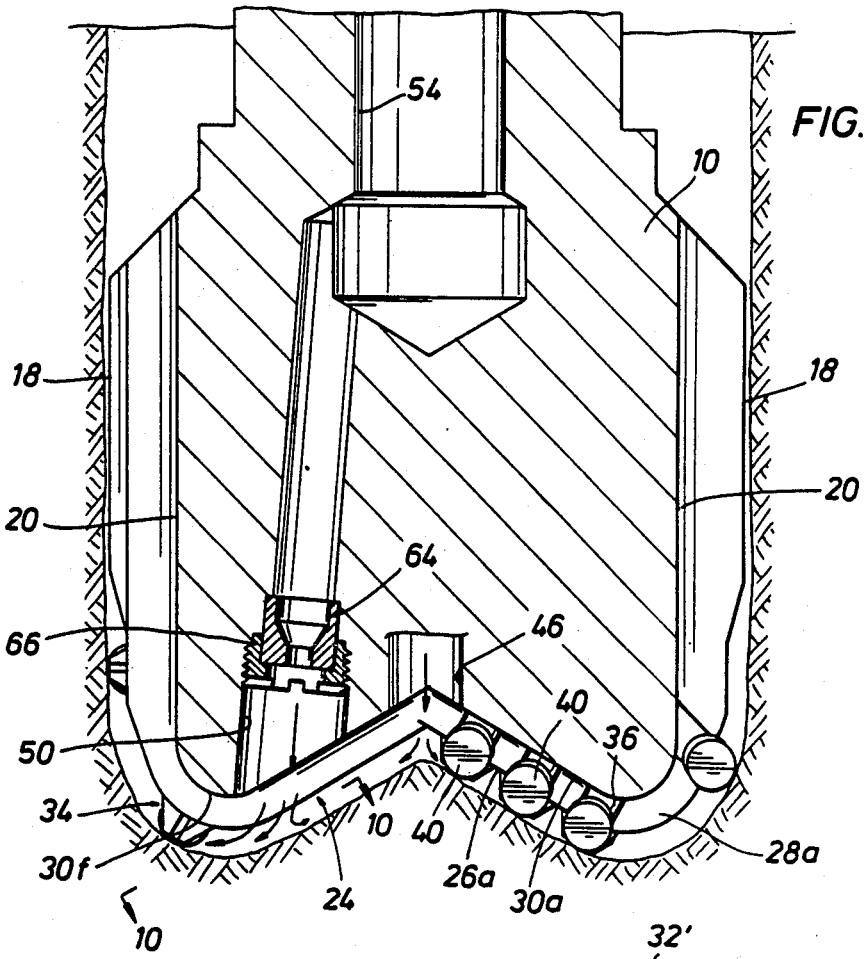
FIG. 4 is a vertical cross-sectional view taken along the line 4–4 of FIG. 2.
Figure 8:
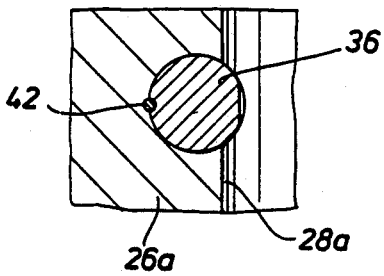
FIG. 8 is a detailed view taken along the line 8—8 of FIG. 5.

Referring now again to FIG. 2, further in conjunction with FIGS. 3 and 4, a plurality of circulation ports 46, 48, 50 and 52 open through end face 24 at varying distances from its centerline each in communication with several of the flow paths 30a–30m. Each of these ports is defined by a rectilinear bore which intersects the larger central bore 54 of the bit body. Each of these smaller rectilinear bores is provided with a removable nozzle fitting. As shown in FIG. 3, the fitting 56 for innermost bore 46 is sealed with respect to that bore by an O-ring 58 carried in an annular groove in the bit body. Nozzle fitting 56 has an external annular groove 60. A nail 62 extends through groove 60 and is also received in an aligned internal groove in bore 46 to removably mount nozzle 56 in that bore in a manner already known in the art. The remaining nozzle fixtures are exemplified by fixture 64 shown in FIG. 4. Nozzle 64 is bottomed against a shoulder formed in bore 50. The outermost part of bore 50 is further enlarged and tapped to receive an externally threaded retaining ring 66 for nozzle 64.

Figure 10:
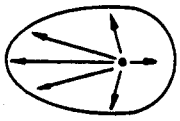
FIG. 10 is a diagramatic view taken along the line 10—10 of FIG. 4 illustrating a fluid flow pattern.

Still referring to FIG. 4, the central portion of end face 24 of the bit body is inwardly concave, more specifically having a generally conical profile. Each of the circulation ports, other than the innermost port 46, has a centerline which intersects the end face 24 of the bit body (and thus the corresponding end face of the borehole) at an angle of about 0° to 40° from the normal to end face 24 at that point. This causes fluid emerging from the port to tend to disperse in a somewhat egg-shaped pattern as shown in FIG. 10. Thus, the tendency is for the major part of the fluid emerging from the port to flow radially outwardly through the adjacent flow path or paths 30*a*–30*m* and carry cuttings upwardly through junk slots 20.

Each of the circulation ports 46, 48, 50 and 52 communicates with more than one of the flow paths 30*a*–30*m*. Thus, only four ports can adequately service 12 flow paths and an equal number of ribs. such a relationship, i.e. with the number of ports being less than the number of flow paths and ribs, is preferred since it allows a greater volume of flow through each of the ports and for each nozzle to have a sufficiently large I.D. to ensure against clogging.

The alternating ribs and flow paths, with the latter communicating with the circulation ports, and the former carrying the cutting members such that the cutting faces 40 face into said flow paths, organizes the fluid flow to best insure that each cutting face 40 is washed and cooled by the circulating fluid. Indeed, the cutting faces 40 themselves on each respective rib lie generally parallel, and more specifically nearly coplanar, to the adjacent cutting face or faces on the same rib so that each cutting face tends to direct the fluid thereacross and toward the next adjacent cutting face. In this sense, "parallel" and "coplanar"are used in a very general sense. Thus, the ribs 26*a*–26*m* could be provided with a slight curvature, with the cutting faces shifted accordingly, and the adjacent cutting faces on such a rib would still be considered generally "parallel" and "coplanar."

The cutting members are further cooled by conduction of heat through the steel of the bit body, and this effect is enhanced by the substantial abutment of the outer ends of the mounting bodies of the cutting members by their respective recess walls as described hereinabove.

The steels and similar metals preferably used for bit body 10, unlike tungsten carbide matrix, are easily machinable to form the alternating rib/channel pattern of the end face as well as the bores 46, 48, 50, 52 and 54. Such metals also readily permit attachment of bodies 36 by interference fits.

Figure 9:
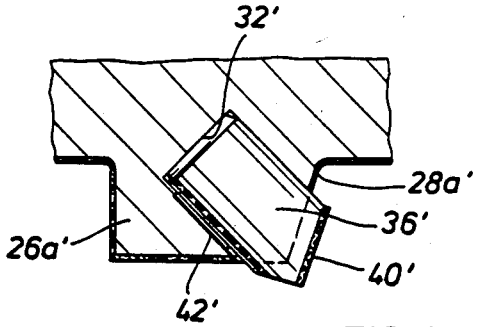
FIG. 9 is a detailed view, similar to that of FIG. 5, showing a modification.

Cutting members could be provided in other forms than those shown in FIGS. 1–8, in which case the configuration of the recesses would be altered accordingly. However, it is always desirable that the mouth of the recess open through the leading edge surface of the respective rib, more specifically at the outermost corner thereof, and extend into the metallic material of the rib. For example, FIG. 9 shows a variation in which the diamond layer 40′ is applied more nearly on the axial end of mounting body 36′, rather than in a more lateral orientation. It can be seen how the orientation of recess 32′ in rib 26*a*′ has been correspondingly altered, so that the mouth of the recess still opens through the leading edge surface 28*a*′. Another variation illustrated in the embodiment of FIG. 9 is the application of the diamond layer 40′ directly to the stud-like mounting body 36′, rather than on an intermediate carrier disc such as 38 of the preceding embodiments.

Other modifications will suggest themselves to those of skill in the art. For example, in the preferred embodiment shown, the profile of the end face of the bit body is such that all cutting members 34 may be mounted in the ribs 26*a*–26*m*. In other designs, e.g. with relatively wider flow paths and fewer ribs, some cutting members may be mounted elsewhere than in the ribs. However, it is nevertheless desirable that at least a majority of the cutting members be mounted in the ribs. In other modifications, the upsets may be in forms other than elongate ribs. Materials, preferably super hard materials such as cubic boron nitrate or boron carbon, may be used as alternatives to the diamond layers described above. Accordingly, it is intended that the scope of the present invention be limited only by the claims which follow.

What is claimed is:

1. A full bore drag type well drilling bit comprising:
a bit body having an operating end face defining a plurality of upsets each having a leading edge surface and at least one recess extending through said leading edge surface into said upset, said end face further comprising a plurality of flow channels, each such leading edge surface having one such flow channel extending therealong and inset therefrom, and at least some of said upsets having a plurality of such recesses spaced therealong, said bit body further having a plurality of circulation ports opening through said end face and a plurality of nozzles, each nozzle being mounted in a respective one of said ports, the number of such nozzles being less than the number of flow channels extending along said leading edge surfaces of said upsets, at least some of said nozzles communicating with more than one of such flow channels, and the minimum transverse crosssectional flow area of each of said nozzles being less than those of individual ones of the channels communicating therewith;
and a plurality of cutting members each comprising a mounting body and a cutting formation defining a cutting face on the exterior of said mounting body adjacent one end thereof, each of said mounting bodies being mounted in a respective one of said recesses with said cutting face facing outwardly along the leading edge surface of the respective one of said upsets.

2. The apparatus of claim 1 wherein said cutting formations are comprised of polycrystalline diamond material.

3. The apparatus of claim 1 wherein each of said cutting faces lies generally to the next adjacent cutting face on the same one of said upsets.

4. The apparatus of claim 3 wherein said cutting formations comprise generally planar cutting faces.

5. The apparatus of claim 1 wherein each of the centerlines of said ports intersects said end face of said bit body at an angle of about 0° to 40° from the normal to the bit body at the point of such intersection.

6. The apparatus of claim 5 wherein each of said ports is located a different radial distance from the centerline of said bit body.

7. The apparatus of claim 1 wherein each of said mounting bodies comprises an elongate stud portion.

8. The apparatus of claim 7 wherein each of said nozzles is removably mounted in the respective port.

9. The apparatus of claim 8 wherein each of said flow channels has a generally uniform width along a substantial portion of its length.

10. The apparatus of claim 1 wherein each of said nozzles is removably mounted in the respective port.

11. The apparatus of claim 1 wherein each of said flow channels has a generally uniform width along a substantial portion of its length.

12. A full bore drag type well drilling bit comprising:

a bit body having an operating end face defining a plurality of upsets each having a leading edge surface and at least one recess extending through said leading edge surface into said upset, said end face further comprising a plurality of flow channels, each such leading edge surface having one such flow channel extending therealong and inset therefrom, and at least some of said upsets having a plurality of such recesses spaced therealong, said bit body further having a plurality of circulation ports opening through said end face and a plurality of nozzles, each nozzle being removably mounted in a respective one of said ports, the number of such nozzles being less than the number of flow channels extending along said leading edge surfaces of said upsets, at least some of said nozzles communicating with more than one of such flow channels;

and a plurality of cutting members each comprising a mounting body and a cutting formation defining a cutting face on the exterior of said mounting body adjacent one end thereof, each of said mounting bodies being mounted in a respective one of said recesses with said cutting face facing outwardly along the leading edge surface of the respective one of said upsets.

13. The apparatus of claim 12 wherein said cutting formations are comprised of polycrystalline diamond material.

14. The apparatus of claim 12 wherein each of said cutting faces lies generally parallel to the next adjacent cutting face on the same one of said upsets.

15. The apparatus of claim 14 wherein said cutting formations comprise generally planar cutting faces.

16. The apparatus of claim 12 wherein each of the centerlines of said ports intersects said end face of said bit body at an angle of about 0° to 40° from the normal to the bit body at the point of such intersection.

17. The apparatus of claim 16 wherein each of said ports is located a different radial distance from the centerline of said bit body.

18. The apparatus of claim 12 wherein each of said mounting bodies comprises an elongate stud portion.

19. The apparatus of claim 12 wherein each of said flow channels has a generally uniform width along a substantial portion of its length.

* * * * *

UNITED STATES PATENT AND TRADEMARK OFFICE

CERTIFICATE OF CORRECTION

PATENT NO. : 4,676,324

DATED : June 30, 1987

INVENTOR(S) : John D. Barr; John M. Fuller

It is certified that error appears in the above-identified patent and that said Letters Patent is hereby corrected as shown below:

In Column 8, line 54, after "generally" insert --parallel--.

Signed and Sealed this

Twenty-seventh Day of October, 1987

*Attest:*

DONALD J. QUIGG

*Attesting Officer*

*Commissioner of Patents and Trademarks*